United States Patent [19]

Uram

[11] Patent Number: 5,067,548

[45] Date of Patent: Nov. 26, 1991

[54] METHOD OF FORMING A CERAMIC MOLD FOR METAL CASTING

[75] Inventor: Stuart Z. Uram, Alpine, N.J.

[73] Assignee: Certech Incorporated, Wood-Ridge, N.J.

[21] Appl. No.: 671,341

[22] Filed: Mar. 19, 1991

[51] Int. Cl.[5] ..... B22C 9/02; B22C 9/12

[52] U.S. Cl. ..... 164/15; 164/27; 164/137

[58] Field of Search ..... 164/6, 12, 15, 23, 27, 164/137, 1, 361

[56] References Cited

U.S. PATENT DOCUMENTS

| | | | |
|---|---|---|---|
| 2,789,331 | 4/1957 | Dietert | 164/27 |
| 2,803,047 | 8/1957 | Dahmer | 164/27 |
| 3,472,310 | 10/1969 | Ernest et al. | 164/137 |
| 3,508,588 | 4/1970 | York | 164/15 X |
| 4,047,882 | 9/1977 | Morita | 164/12 X |
| 4,276,922 | 7/1981 | Brookes | 164/27 |

*Primary Examiner*—J. Reed Batten, Jr.

*Attorney, Agent, or Firm*—Amster, Rothstein & Ebenstein

[57] ABSTRACT

Individual mold sections are injection molded from a slurry of ceramic particles and a binder. Each of the green individual mold sections is low temperature fired to remove therefrom a major portion of the binder while leaving therein a minor portion of the binder sufficient to afford structural strength thereto, and the individual mold sections are assembled together to form a mold. Finally the mold is high temperature fired to complete removal of the binder.

14 Claims, 4 Drawing Sheets

FIG. 4
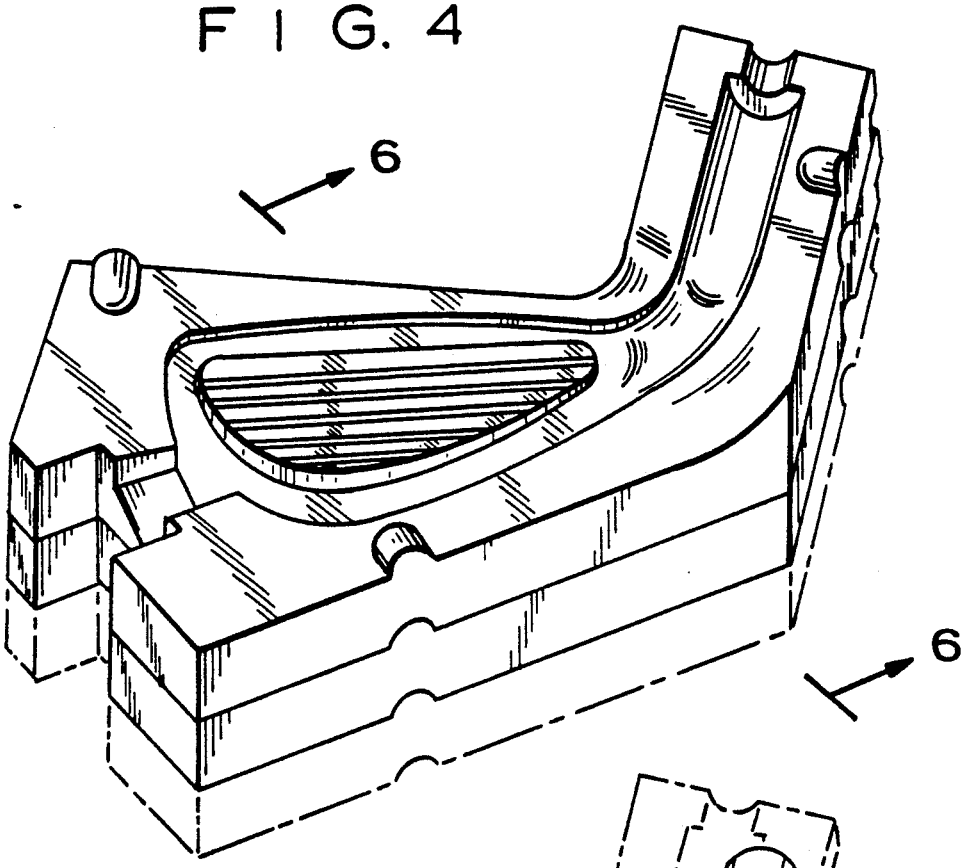
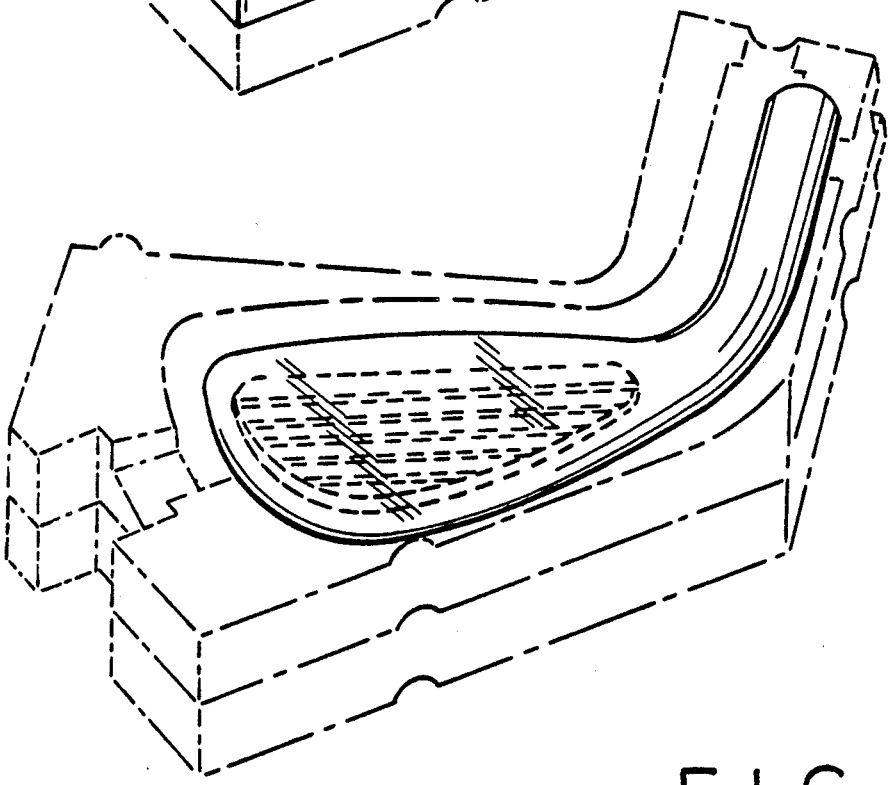
FIG. 5

METHOD OF FORMING A CERAMIC MOLD FOR METAL CASTING

BACKGROUND OF THE INVENTION

The present invention relates to a method of forming a ceramic mold for metal casting, and more particularly to a method of forming a ceramic mold for producing metal castings for products such a golf club heads.

Various methods of forming ceramic molds for metal casting are well known in the art. Traditional investment casting involves the "lost wax process". In the process, substantial time-consuming preparation of the mold is required, including the initial welding of the wax patterns to a gate and then the laborious lost wax mold building process. The resultant mold typically lacks the high strength which is required in order to permit very fine details, such as grooves, lettering or other features, to be incorporated into the metal casting, thus requiring such features to be added later through additional processing. A further disadvantage of the lost wax process is that the mold built up about the wax cannot be visually inspected to insure that, when used, the resultant metal casting will be of the appropriate configuration and dimensions.

In another method, the ceramic molds are made by pouring a slurry of ethyl silicate and a refractory ceramic to form two mold halves and then "booking" or assembling the two mold halves together to form the mold. This method is not only labor intensive and hence very expensive, but also fails to provide adequate dimensional control and alignment of the mold halves. Accordingly, the method is not well suited for forming a ceramic mold for metal castings having precise dimensions.

Another process, developed originally for the casting of turbine blades, involves forming a plurality of ceramic mold sections—one section to mold one outer part of the blade, another section to mold the interior of the blade, and a third section to mold the other outer part of the blade—with the individual mold sections being made by injection molding or some other ceramic core process. The mold suffers from a tolerance buildup that does not permit sufficient dimensional control along parting lines of the mold; accordingly, again, the method is not well suited for the production of ceramic molds for metal castings of precise dimensions.

Accordingly, it is an object of the present invention to provide an improved method of forming a ceramic mold for metal casting suitable for producing metal articles of precise dimensions.

Another object is to provide such a method which requires only a minimum of mold preparation.

A further object is to provide such a method which can be performed in a small, confined area at a rapid rate, with the mold being ready for casting in less than 24 hours.

It is another object of the present invention to provide such a method in which the resultant mold is of high strength, permitting fine detail to be incorporated into the metal casting.

It is also an object to provide such a method which permits the mold pieces to be inspected prior to casting.

SUMMARY OF THE INVENTION

The above and related objects of the present invention are obtained in a method of forming a, ceramic mold for metal casting comprising the following steps.

Individual mold sections are injection molded from a slurry of ceramic particles and a binder. Each of the green individual mold sections is low temperature fired to remove therefrom a major portion of the binder while leaving therein a minor portion of the binder sufficient to afford structural strength thereto, and the individual mold sections are "booked" or assembled together to form a mold. Finally the mold is high temperature fired to complete removal of the binder.

Preferably the slurry is non-aqueous, and the binder is comprised substantially of wax and plasticizer. The green individual mold sections are low temperature fired by slowly increasing their temperature to about 300° F., where they are held for a period of not more than about 18 hours.

Optionally the individual mold sections are inspected prior to assembling them together to form an assembled mold. The individual mold sections are then assembled together in a jig, adhesively secured together, or otherwise booked to form a complete mold. The mold is eventually high temperature fired to at least about 1800° F.

Each of the green individual mold sections is low temperature fired either before or after being assembled to form a complete mold. In either instance, the high temperature firing of the mold is preferably followed immediately by the step of using the mold to cast a product without the mold being allowed to cool.

BRIEF DESCRIPTION OF THE DRAWING

The above and related objects of the present invention will be more fully understood by reference to the following detailed description of the presently preferred, albeit illustrative, embodiments of the present invention when taken in conjunction with the accompanying drawing wherein:

FIG. 4 is an isometric view of two mold sections assembled together to form a mold;

FIG. 5 is a view similar to FIG. 4, but with the cavity of the mold being illustrated in solid line and the mold in phantom line.

DETAILED DESCRIPTION OF THE PREFERRED EMBODIMENTS

While the following description of the method of the present invention is specifically directed to the formation of a ceramic mold for the casting of a metal head for a golf club, it will be appreciated that the principles of the present invention are equally applicable to the formation of metal castings of different configurations and dimensions which also require a high level of precision and accuracy.

Figure 1:
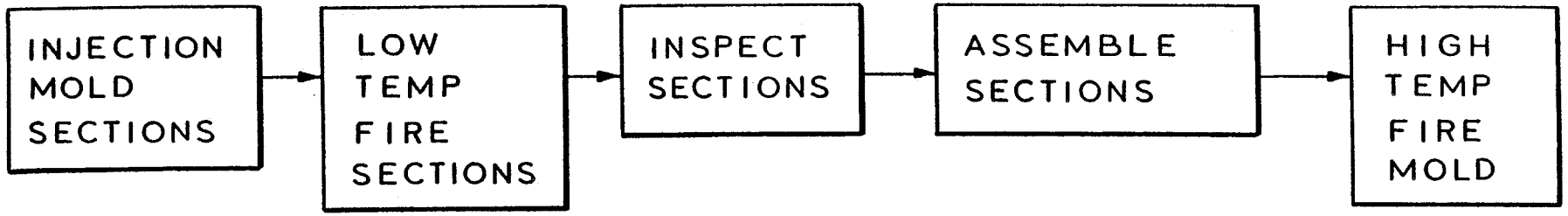
FIG. 1 is a flow chart for a first preferred embodiment of the present invention.
Figure 3A:
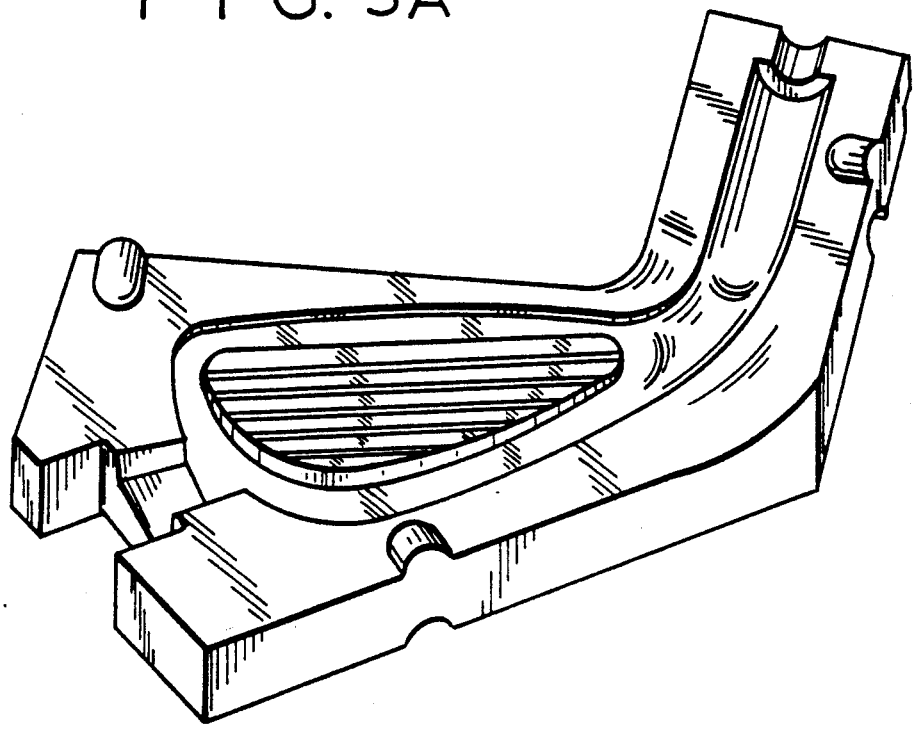
FIGS. 3A and 3B are front and rear elevational views, respectively, of an individual mold section made for use in the present invention.
Figure 3B:
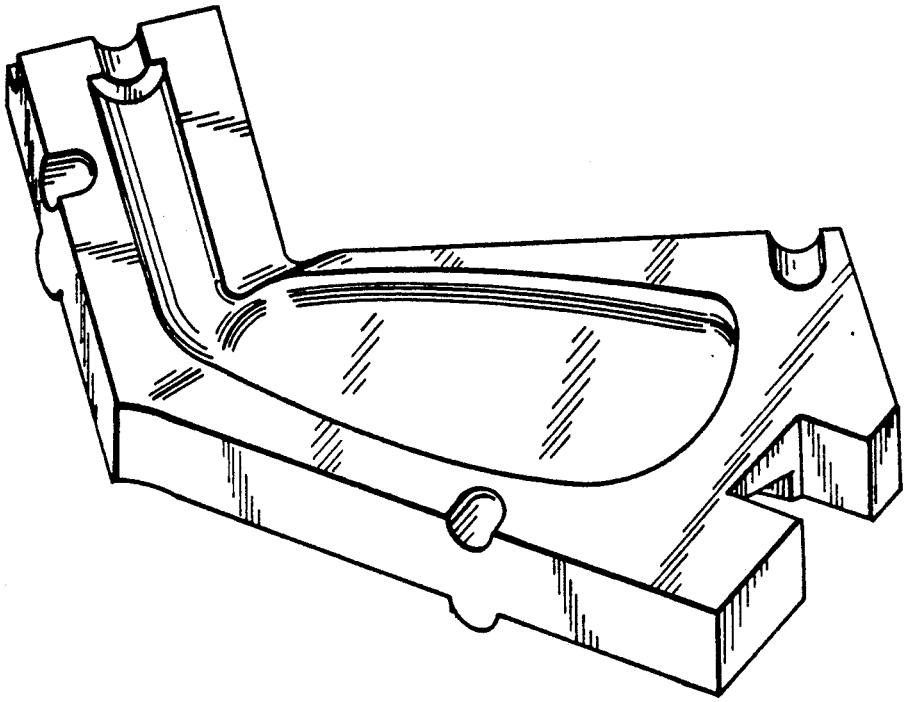
Figure 6:
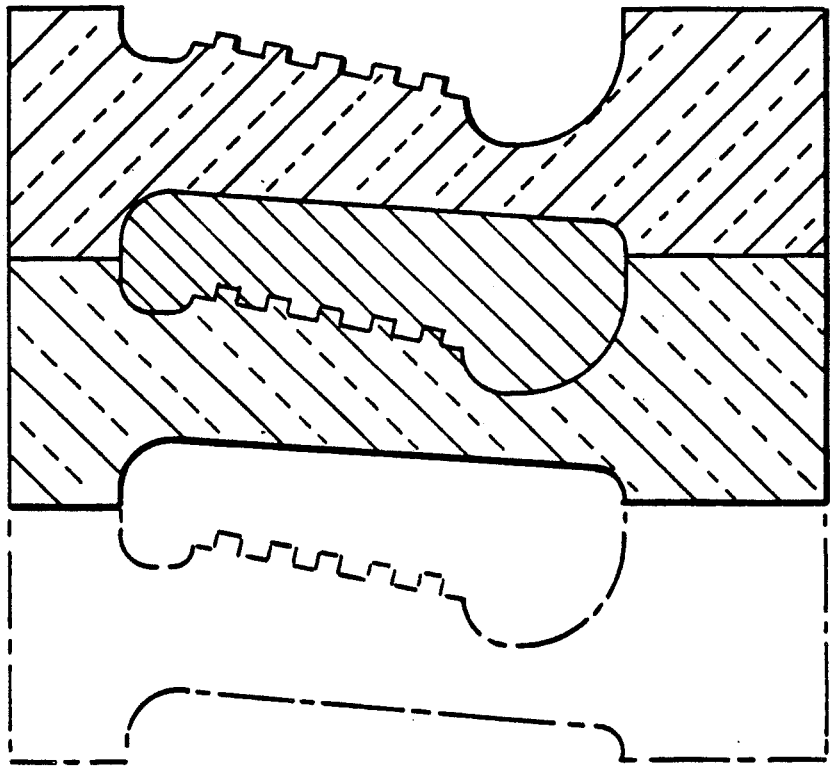
FIG. 6 is a sectional view of the mold taken along the line 6—6 of FIG. 4.

Referring now to the drawing, and in particular to FIGS. 1, 3A and 3B thereof, a preferred embodiment of the method for forming a ceramic mold for metal casting commences with the step 10 (see FIG. 1) of injection molding individual mold sections generally designated by the reference numeral 12. The mold sections 12 are formed by conventional injection molding from a slurry of ceramic particles and a binder. Preferably the slurry is non-aqueous, and the binder is comprised substantially of wax and plastic. A preferred composition for the slurry comprises, per 100 parts, 87.5 parts of a blended refractory powder consisting of 70% coarse fused silica (preferred particle size 50–120 mesh) and 30% by weight zircon (preferred particle size 325–600 mesh), mixed with 12.5 parts by weight of organic binder material consisting of paraffin or like wax and stearic acid or like plasticizer. While the above-identified composition is preferred, clearly other silicas and/or silicates (zircon is zirconium silicate) may be used, as well as other binders, in like or different proportions.

While FIGS. 3A and 3B illustrate opposite sides of a single individual mold section, two of these mold sections may be assembled together to form a mold 14 defining a single cavity for producing a single product 16. Obviously N different sections may be assembled together in like manner to form a series of (N minus 1) mold cavities for producing a series of (N minus 1) products.

Referring again to FIG. 1, in the next step 20, each of the green (that is, unfired) individual mold sections is then low temperature fired to remove therefrom a major portion of the binder (at least 51% thereof by weight), while leaving therein a minor portion of the binder sufficient to afford sufficient structural strength thereto for requisite handling thereof at least 10% thereof by weight). While the parameters of the low temperature firing step may vary with the composition, configuration and dimensions of the individual mold sections, typically the low temperature firing is accomplished by slowly increasing the temperature of the individual mold sections from room temperature to about 300° F., and maintaining them at such elevated temperature over a prolonged period, typically not more than 18 hours. The preferred parameters for the low temperature firing of a particular individual mold section may be easily determined with a minimum amount of experimentation by those skilled in the firing art, keeping in mind the goal of removing a major portion of the binder while leaving therein a minor portion of the binder sufficient to afford structural strength thereto. Optimally about 70% by weight of the binder is removed during the low temperature firing.

An optional inspection step 30 may be performed on the low temperature fired individual mold sections to ensure that the operative surfaces thereof are as required to produce the desired metal casting. It will be appreciated that the green individual mold sections may also be inspected prior to the low temperature firing.

In the next step 40, the low temperature fired (and optionally inspected) individual mold sections are "booked" or assembled together to form a complete mold, generally designated by the reference numeral 14 (see FIG. 4). Each pair of adjacent mold pieces 12 in the mold 14 defines a cavity for producing an article 16. As one surface 12*a* of one individual mold section defines one half of the golf club head (or like article to be cast) and keys 13, and as the facing surface 12*b* of the other mold section defines the other half of the golf club head and keyways 15, when an array of these individual mold sections 12 is stacked together with the keys 13 in the keyways 15, each adjacent pair of mold sections 12 forms a mold 14 which defines a cavity into which liquid metal can be cast to produce a metal golf club head 16.

The individual mold sections 12 may be assembled together to form the mold 14 either manually or by machine. The individual mold sections 12 may be assembled by using either a jig or vice to temporarily maintain the mold sections in the appropriate juxtaposition, by using adhesive to permanently secure the mold sections together, or by other means well known to those skilled in the art of making and using multisection molds.

Referring again to FIG. 1, in the next step 50 the mold 14 is high temperature fired to complete removal of the binder. As with the low temperature firing of the individual mold sections 12, the parameters for the high temperature firing of the individual mold sections will depend upon the composition, configuration, and dimensions of the mold 14. A preferred profile for the high temperature firing involves heating the mold from 300° F. to 2150° F. at a rate of 200° F. per hour and holding the assembled mold at 2150° F. for a period sufficient to complete removal of the binder, typically about 6.5 hours.

It will be appreciated that the low temperature firing step 20 is essential to gradually reduce the quantity of binder which has to be removed during the high temperature firing step 50. The low temperature firing results in only minor dimensional changes of the individual mold sections relative to the greater dimensional changes which normally occur during the high temperature firing.

Conventionally the injection molding of the individual mold sections 12 and all firing thereof is performed at one location—namely, the mold-maker plant. The fired mold sections (whether assembled or not) are then shipped to a foundry where the mold 14 will be used in producing the metal castings. The metal caster eventually heats the mold sections at the foundry to very high temperatures (at least 1800° F.) before their use in metal casting so as to reduce premature cooling of the molten metal eventually poured into the mold at the foundry.

According to the present invention, however, the high temperature firing of the mold section to complete removal of the binder may be performed at the foundry rather than at the mold maker, with the high temperature firing of the mold sections to complete removal of the binder being followed immediately by use of the high temperature fired mold in casting the metal part without cooling the mold (i.e., allowing it to return to room temperature). Accordingly, the present invention provides a substantial saving in energy expenditure as the high temperature heating of the mold is performed only once (at the foundry) rather than twice (at the mold-maker and then again at the foundry). The metal caster preheats the mold sections at the foundry to a temperature of at least about 1800° F. to reduce premature cooling of the molten metal, this temperature typically being sufficient to complete removal of the binder and thus serve as the high temperature firing. As the preheating is a conventional part of the casting process, the mold preparation, its low temperature firing, and its assembly can be completed in less than 24 hours, typically substantially less. Accordingly, the mold forming process can be performed in a small, confined area at a rapid rate, with the mold being ready for casting (including high temperature firing) within 24 hours.

Figure 2:
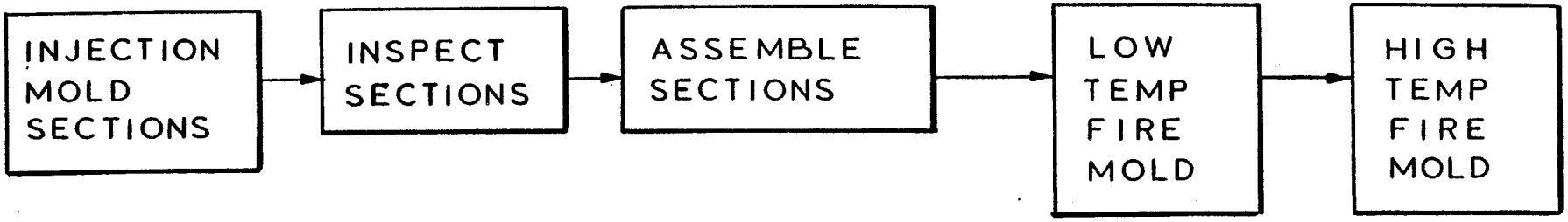
FIG. 2 is a flow chart for a second preferred embodiment of the present invention.

FIG. 2 illustrates another preferred embodiment of the method of the present invention. The injection molding step 10' of the second embodiment is similar to the injection molding step 10 of the first embodiment, but the optional inspection step 30' follows the injection molding step 10' rather than the low temperature firing step. In the assembly step 40' of the second embodiment the green individual mold sections are "booked" or assembled together to form the mold, and the mold is then subjected to a low temperature firing step 20' similar to the low temperature firing step 20 of the first embodiment. The high temperature firing step 50' of the second embodiment is similar to the high firing step 50 of the first embodiment.

It will be appreciated that the primary difference between the second embodiment of FIG. 2 and the first embodiment of FIG. 1 is that in the second embodiment the green individual mold sections 12 are assembled together in step 40' to form a mold 14 prior to low temperature firing 20' (whereas in the first embodiment the green individual mold sections 12 are low temperature fired in step 20 prior to their assembly into a mold 14 in step 40). As it is harder to remove binder from a mold 14 rather than from individual mold sections 12, due to the increased mass of the mold 14 relative to the individual mold sections 12, more readily volatilized aqueous binders such as methyl cellulose or agar may be profitably used in the second embodiment. The second embodiment is particularly useful where very accurate dimensioning across the parting line is required since all firing of the individual mold sections occurs after they are formed into a mold, thus avoiding a tolerance buildup that may occur in multiple separate firings. As in the case of the first embodiment, the high temperature firing of the mold in the second embodiment is preferably performed at the foundry, rather than at the mold maker, in order to conserve energy and reduce costs to the mold maker.

To summarize, the present invention provides a method for forming a ceramic mold for metal casting wherein mold preparation is greatly reduced compared to conventional investing casting as it is unnecessary to weld wax patterns to a gate and then proceed through a laborious mold building process. The process can be performed in a small, confined area at a rapid rate, with the mold being ready for casting within 24 hours. The mold sections are available for inspection, and the resultant mold has a high strength permitting very fine details to be incorporated into the metal casting.

Now that the preferred embodiments of the present invention have been shown and described in detail, various modifications and improvements thereon will become readily apparent to those skilled in the art. Accordingly, the spirit and scope of the present invention is to be construed broadly and in a manner consistent with the appended claims, and not limited by the foregoing disclosure.

I claim:

1. A method of forming a ceramic mold for metal casting, comprising the steps of:

(A) injection molding individual green mold sections from a slurry of ceramic particles and a binder;

(B) firing each of the individual green mold sections at a relatively low temperature for an extended period of time to remove therefrom a major portion of the binder while leaving therein a minor portion of the binder sufficient to afford structural strength thereto, and assembling the individual mold sections together to form a mold; and (C) firing the mold at a high temperature to complete removal of the binder.

2. The method of claim 1 wherein said slurry is non-aqueous.

3. The method of claim 1 wherein said binder is comprised substantially of wax and plasticizer.

4. The method of claim 1 wherein said individual green mold sections are low temperature fired by slowly increasing the temperature thereof to about 300° F.

5. The method of claim 1 wherein said low temperature firing maintains the temperature of said individual green mold sections at about 300° F. over a period of not more than about 18 hours.

6. The method of claim 1 wherein said individual mold sections are assembled together in a jig.

7. The method of claim 1 wherein said individual mold sections are adhesively secured together.

8. The method of claim 1 including the additional step of inspecting the individual mold sections prior to assembling them together to form a mold.

9. The method of claim 1 wherein the mold is high temperature fired to at least about 1800° F.

10. The method of claim 1 wherein the high temperature firing of the mold to complete removal of the binder is followed immediately by the additional step of using the high temperature fired mold in metal casting without the mold being allowed to cool to room temperature therebetween.

11. The method of claim 1 wherein in step (B) each of the individual green mold sections is low temperature fired before being assembled together to form a mold.

12. The method of claim 1 wherein in step (B) each of the individual green mold sections is low temperature fired after being assembled together to form a mold.

13. A method of forming a ceramic mold for investment casting, comprising the steps of:

(A) injection molding individual green mold sections from a non-aqueous slurry of ceramic particles and a binder comprised substantially of wax and plasticizer;

(B) low temperature firing each of the green individual green mold sections by slowly increasing the temperature thereof to about 300° F. and maintaining it at that temperature to remove therefrom a major portion of the binder while leaving therein a minor portion of the binder sufficient to afford structural strength thereto;

(C) inspecting the low temperature fired individual mold sections;

(D) assembling the inspected individual mold sections together to form a mold;

(E) high temperature firing the mold by increasing the temperature thereof to at least about 1800° F. to complete removal of the binder; and (F) using the high temperature fired mold in metal casting without the mold being allowed to return to room temperature after its high temperature firing.

14. A method of forming a ceramic mold for investment casting, comprising the steps of:

(A) injection molding individual mold sections from a non-aqueous slurry of ceramic particles and a binder comprised substantially of wax and plasticizer;

(B) inspecting the individual mold sections;

(C) assembling the inspected individual mold sections together to form a mold;

(D) low temperature firing the formed mold by slowly increasing the temperature thereof to about 300° F. and maintaining it at that temperature to remove therefrom a major portion of the binder while leaving therein a minor portion of the binder sufficient to afford structural strength thereto;

(E) high temperature firing the mold by increasing the temperature thereof to at least about 1800° F. to complete removal of the binder; and (F) using the high temperature fired mold in metal casting without the mold being allowed to return to room temperature after its high temperature firing.

* * * * *